US011180273B2

(12) United States Patent
Blaul

(10) Patent No.: US 11,180,273 B2
(45) Date of Patent: Nov. 23, 2021

(54) BAG FRAME

(71) Applicant: Eyeganics LLC

(72) Inventor: Christopher Blaul, Santa Barbara, CA (US)

( * ) Notice: Subject to any disclaimer, the term of this patent is extended or adjusted under 35 U.S.C. 154(b) by 0 days.

(21) Appl. No.: 16/295,895

(22) Filed: Mar. 7, 2019

(65) Prior Publication Data

US 2019/0202589 A1 Jul. 4, 2019

Related U.S. Application Data

(63) Continuation-in-part of application No. 16/160,700, filed on Oct. 15, 2018, now abandoned.

(60) Provisional application No. 62/572,200, filed on Oct. 13, 2017.

(51) Int. Cl.

| | |
|---|---|
| ***B65F 1/00*** | (2006.01) |
| ***B65B 67/12*** | (2006.01) |
| ***B65F 1/02*** | (2006.01) |
| ***B65F 1/14*** | (2006.01) |
| *B65F 1/06* | (2006.01) |

(52) U.S. Cl.

CPC ..... *B65B 67/1238* (2013.01); *B65F 1/0006* (2013.01); *B65F 1/02* (2013.01); *B65F 1/1415* (2013.01); *B65F 1/0073* (2013.01); *B65F 2001/061* (2013.01); *B65F 2250/108* (2013.01)

(58) Field of Classification Search

USPC ..... 248/95, 97, 99; 211/85.15; 383/33

See application file for complete search history.

(56) References Cited

U.S. PATENT DOCUMENTS

| | | | | |
|---|---|---|---|---|
| 4,440,430 | A * | 4/1984 | Kruse | B65B 67/1238 15/257.1 |
| 4,705,246 | A * | 11/1987 | Wolf | B65B 67/12 141/390 |
| 5,499,787 | A * | 3/1996 | Bonomo | B65B 67/12 248/188 |
| 6,520,451 | B1 * | 2/2003 | Moore | B64D 11/00 244/118.5 |
| 2004/0184679 | A1 * | 9/2004 | Williamson | B65D 88/1612 383/38 |
| 2010/0200709 | A1 * | 8/2010 | Wilkinson | B65B 67/1238 248/99 |
| 2013/0019995 | A1 * | 1/2013 | Muse | B65F 1/1415 141/340 |

* cited by examiner

*Primary Examiner* — Alfred J Wujciak
(74) *Attorney, Agent, or Firm* — Patent Service Associates, Inc.; Lyman Smith

(57) ABSTRACT

An exemplary bag frame includes a framework to be inserted into and hold open a paper grocery bag which is then used as a trash/waste, sorting, collecting or storage receptacle. The bag frame includes four spaced apart vertical legs and that are configured to be inserted within the four corner edges of the paper bag. A planar upper rim connects the upper ends of the four legs and covers the upper edge of the paper bag. The bag frame resembles a small table with an almost completely open top. The vertical legs in the top rim are coupled in a snap-fit manner for easy assembly and disassembly.

19 Claims, 12 Drawing Sheets

BAG FRAME

RELATED APPLICATIONS

This application is a continuation-in-part of U.S. patent application Ser. No. 16/160,700, filed Oct. 15, 2018, which claims the benefit of priority of U.S. provisional application No. 62/572,200, filed Oct. 13, 2017, the contents of both of which are herein incorporated by reference.

FIELD OF THE INVENTION

The present application is directed to a device for converting a bag to an open top receptacle, in particular for converting a standard grocery store bag into a stand-alone receptacle.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The problem of solid waste disposal and excess plastic in the waste stream grows every year as population grows. One source of such waste is the ubiquitous plastic bags used to collect and dispose of such waste in residences and businesses. People regularly fill up and toss out large numbers of plastic bags each month, adding to the problem. Stores now provide or sell for a small charge paper bags, but those typically become refuse as well.

There is a need for a more environmentally-friendly way to dispose of trash.

SUMMARY OF THE INVENTION

This application presents a paper bag supporter or frame particularly designed for standard paper grocery bags. This lightweight low-cost device desirably made from hard plastic provides internal structural support allowing paper bags to function as a free-standing waist or sorting receptacle. This product is not only cost efficient in that it obviates the need for a trash can or replacement liners, but also paper grocery bags may be re-purposed. Although the bag frame is specially designed for different bags, it may also be used with plastic bags with minor modifications. It should be understood that although the formation of a trash receptacle is a primary advantage of the frame described herein, receptacles for sorting, collecting or otherwise storing items may be formed.

An exemplary bag frame comprises a framework to be inserted into and hold open a paper grocery bag which is then used as a trash/waste or other receptacle. The bag frame includes four spaced apart vertical legs and that are configured to be inserted within the four corner edges of the paper bag. A planar upper rim connects the upper ends of the four legs and covers the upper edge of the paper bag. The bag frame resembles a small table with an almost completely open top. The vertical legs in the top rim are coupled in a snap-fit manner for easy assembly and disassembly.

These and other features, aspects and advantages of the present invention will become better understood with reference to the following drawings, description and claims.

BRIEF DESCRIPTION OF THE DRAWINGS

Some embodiments of the present invention are illustrated as an example and are not limited by the figures of the accompanying drawings, in which like references may indicate similar elements.

Figure 1A:
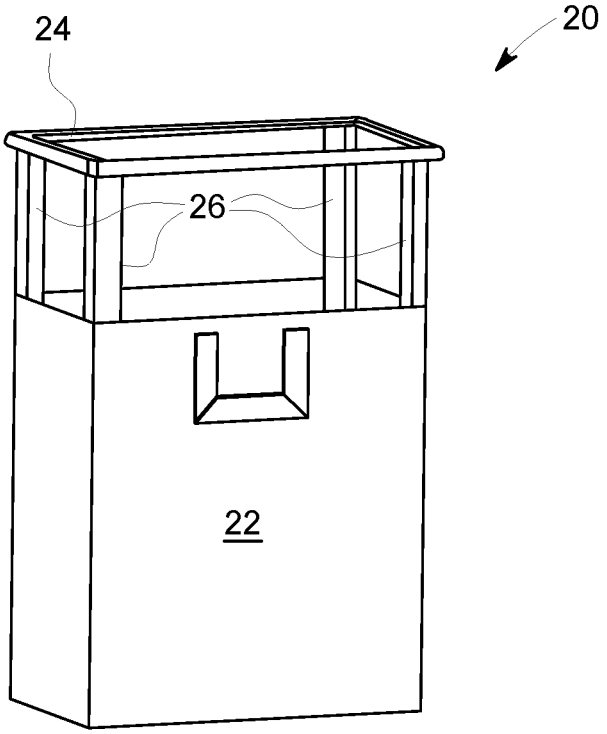
FIG. 1A is a perspective view of an assembled bag frame, according to an exemplary embodiment of the present invention, partially inserted into a paper grocery bag.

Unless otherwise indicated illustrations in the figures are not necessarily drawn to scale.

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

As is well known to those skilled in the art, many careful considerations and compromises typically must be made when designing for the optimal configuration of a commercial implementation of any apparatus, and in particular, the embodiments of the present invention. A commercial implementation in accordance with the spirit and teachings of the present invention may be configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

Broadly, embodiments of the present invention provide a bag frame that includes a framework to be inserted into and hold open a paper grocery bag, for example, which is then used as a trash/waste, sorting, collecting or storage receptacle, or the like. The bag frame can include four spaced apart vertical legs and that are configured to be inserted within the four corner edges of the paper bag. A planar upper rim connects the upper ends of the four legs and covers the upper edge of the paper bag. The bag frame resembles a small table with an almost completely open top. The vertical legs in the top rim are coupled in a snap-fit manner for easy assembly and disassembly.

Figure 1B:
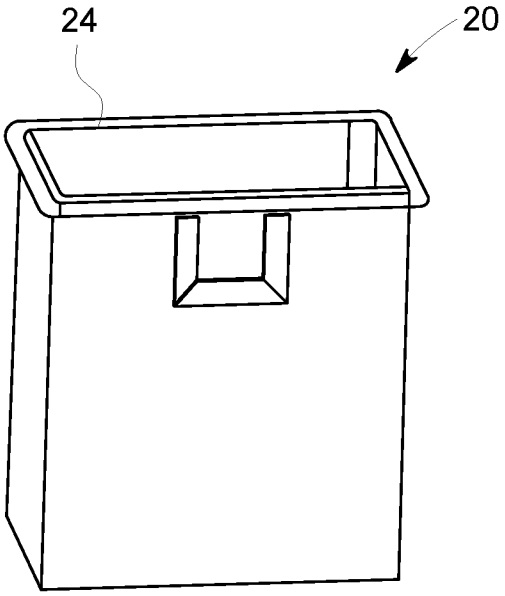
FIG. 1B is a perspective view of the assembled bag frame of FIG. 1 fully inserted into the paper grocery bag.

With reference now to FIGS. 1A and 1B, a perspective view of an exemplary assembled bag frame 20 of the present application is partially and fully inserted into a paper grocery bag 22. The bag frame 20 is seen in various perspective, orthogonal, sectional and exploded views in FIGS. 2A through 4F.

Referring to FIGS. 1A through 4F, the bag frame 20 can include an upper rim 24 connecting and supported by a plurality, typically four, legs 26. Typically, the legs 26 extend orthogonally from a bottom of the bag frame 20. In some embodiments, the legs 26 may extend downward from the upper rim 24 at a slight outward angle. This angle may be such that an outline defined by the ends of the legs 26 is larger than the outer dimensions of the upper rim 24. Typically, this distance is small, typically from about 0.1 to about 0.5 inches in both the length and width directions. Such an outward extension of the legs 26 may be beneficial for engaging an inside surface of the grocery bag 22. However, such an outward extension of the legs 26 is not required for proper use and function of the bag frame 20 according to embodiments of the present invention.

As seen in FIG. 1A, the legs 26 may be spaced apart at four corners of a rectangle which may fit closely within the confines of the paper bag 22. The horizontal dimensions of a standard paper bag are about 12 inches wide by about 7 inches deep, and the height is typically about 14", though shorter and taller bags are available. Moreover, the bag frame 20 may be customized to fit any size of bag on the market, and, as such, should not be considered limited to fitting within paper grocery bags.

Figure 2E:
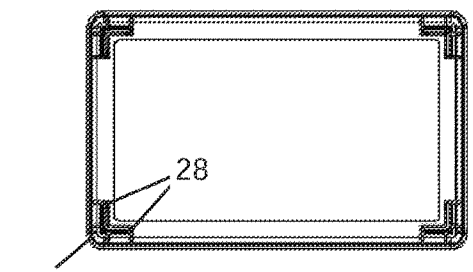
FIGS. 2A-2F are perspective and orthogonal views of the bag frame of FIG. 1.
Figure 2F:
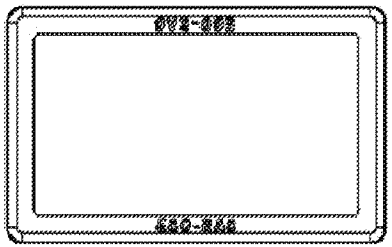
Figure 2C:
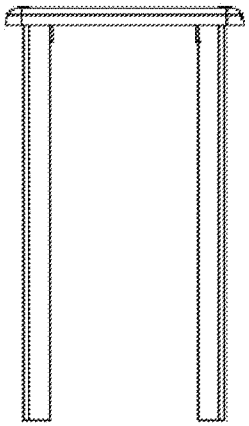
Figure 2D:
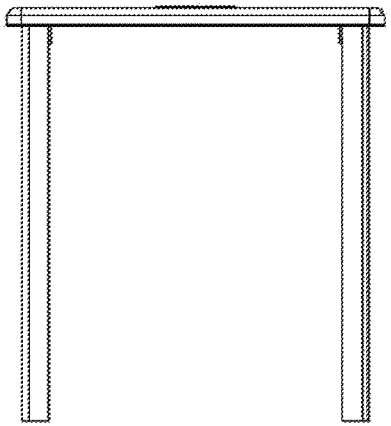
Figure 2A:
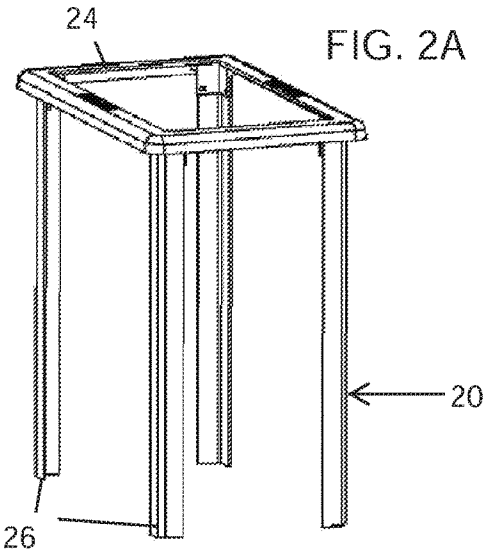
Figure 2B:
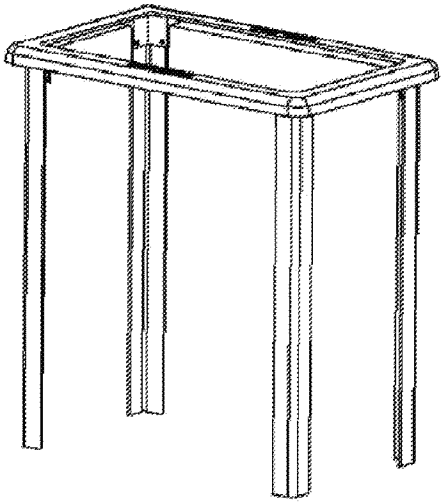

Each of the legs 26 may be formed in a right-angle configuration with two planar sides 28 joined at an outer corner 30, as best seen in FIG. 2E. The corner 30 may be rounded to avoid ripping the paper hag 22.

With reference to FIGS. 4A-4F, the upper rim 24 may include a horizontal upper wall 32 around its four sides that typically aligns with a rectangular opening 34 of the paper bag 22. An outer vertical wall 36 on all four sides of the upper rim 24 may be formed in a right-angle shape with the horizontal upper wall 32 and may be sized to extend downward outside of the paper bag 22. In this way, the upper rim 24 forms a hard upper protective frame for the top edge of the paper bag and a well-defined opening 34 through which to toss trash or other items into the interior of the paper bag 22.

Figure 3A:
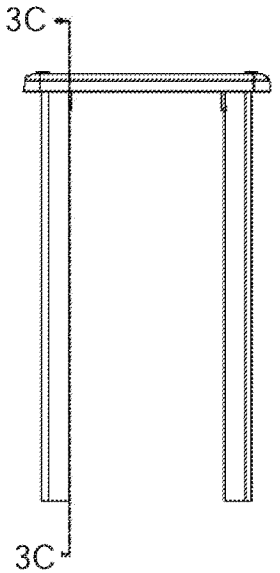
FIGS. 3A-3E are side elevational and sectional views of the bag frame of FIG. 1.
Figure 3C:
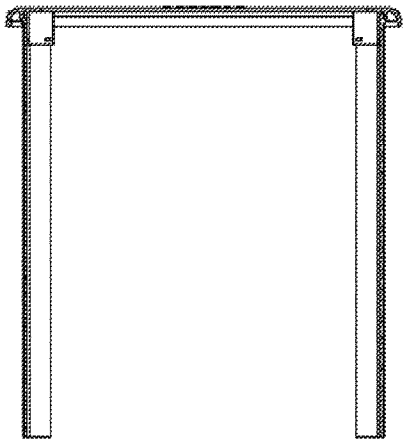
Figure 3E:
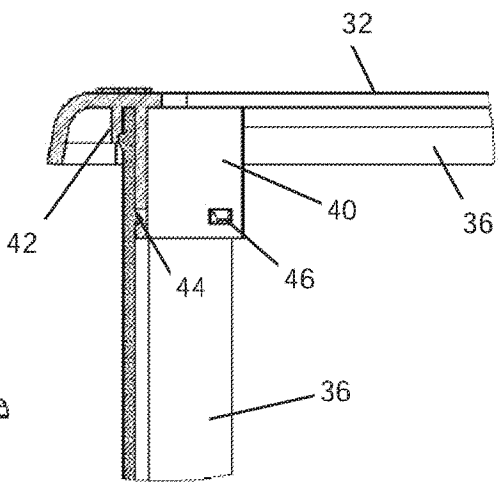
Figure 3B:
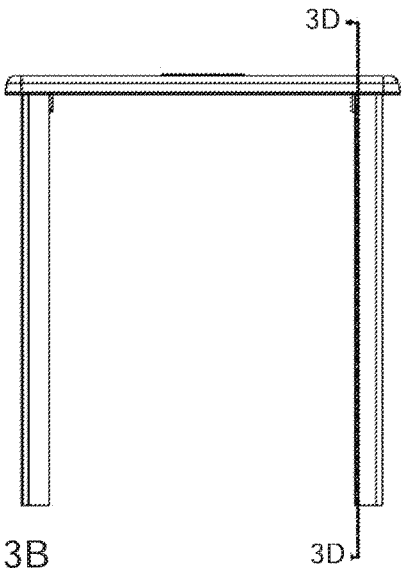
Figure 3D:
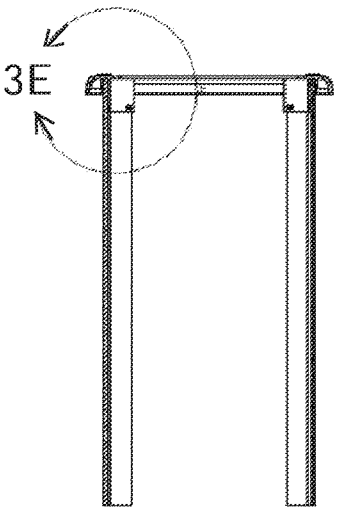
Figure 4B:
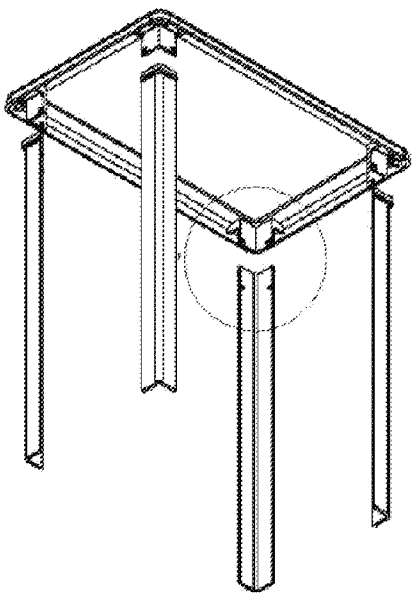
FIGS. 4A-4F are various orthogonal and exploded views of the bag frame of FIG. 1.
Figure 4F:
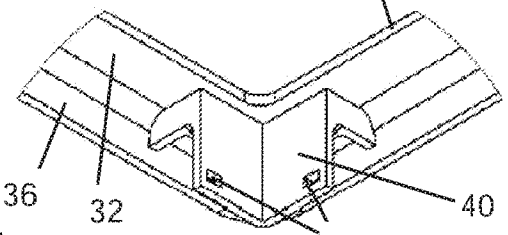
Figure 4D:
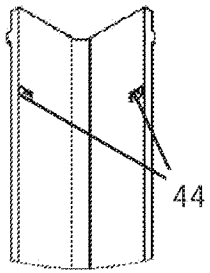
Figure 4D:
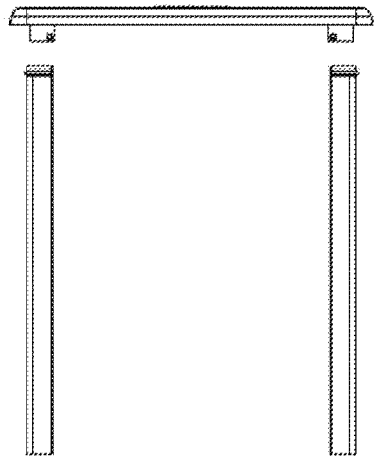
Figure 4E:
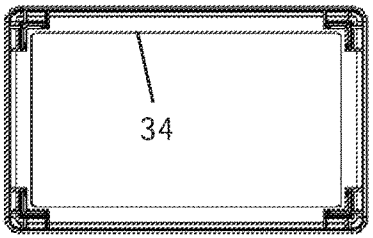
Figure 4C:
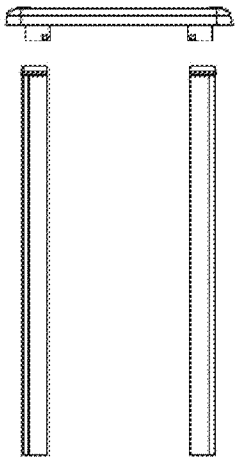
Figure 4A:
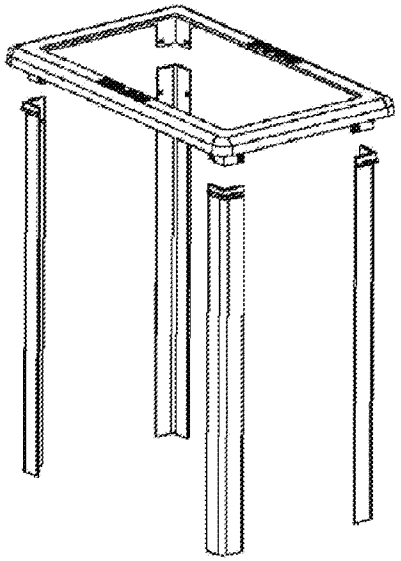
Figure 5:
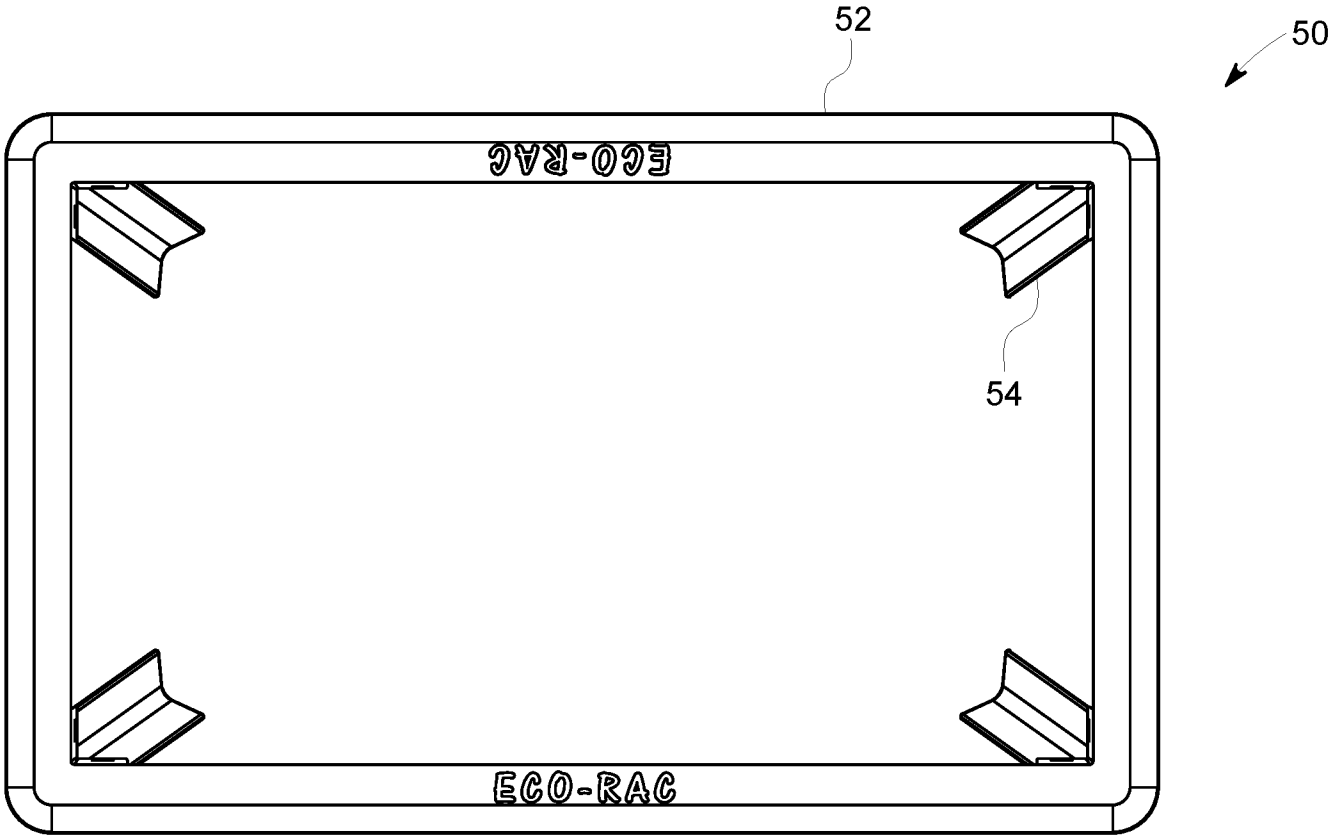
FIG. 5 is top view of a bag frame according to an exemplary embodiment of the present invention.
Figure 6:
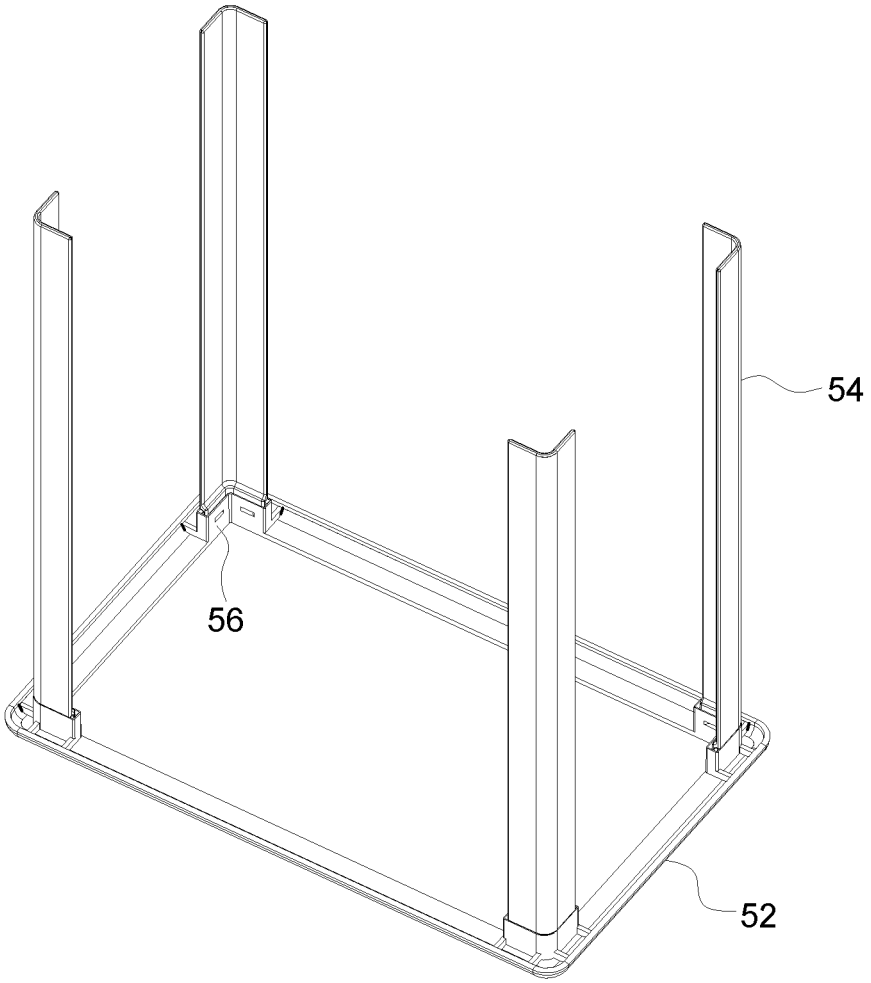
FIG. 6 is a bottom perspective view of the bag frame of FIG. 5.
Figure 7:
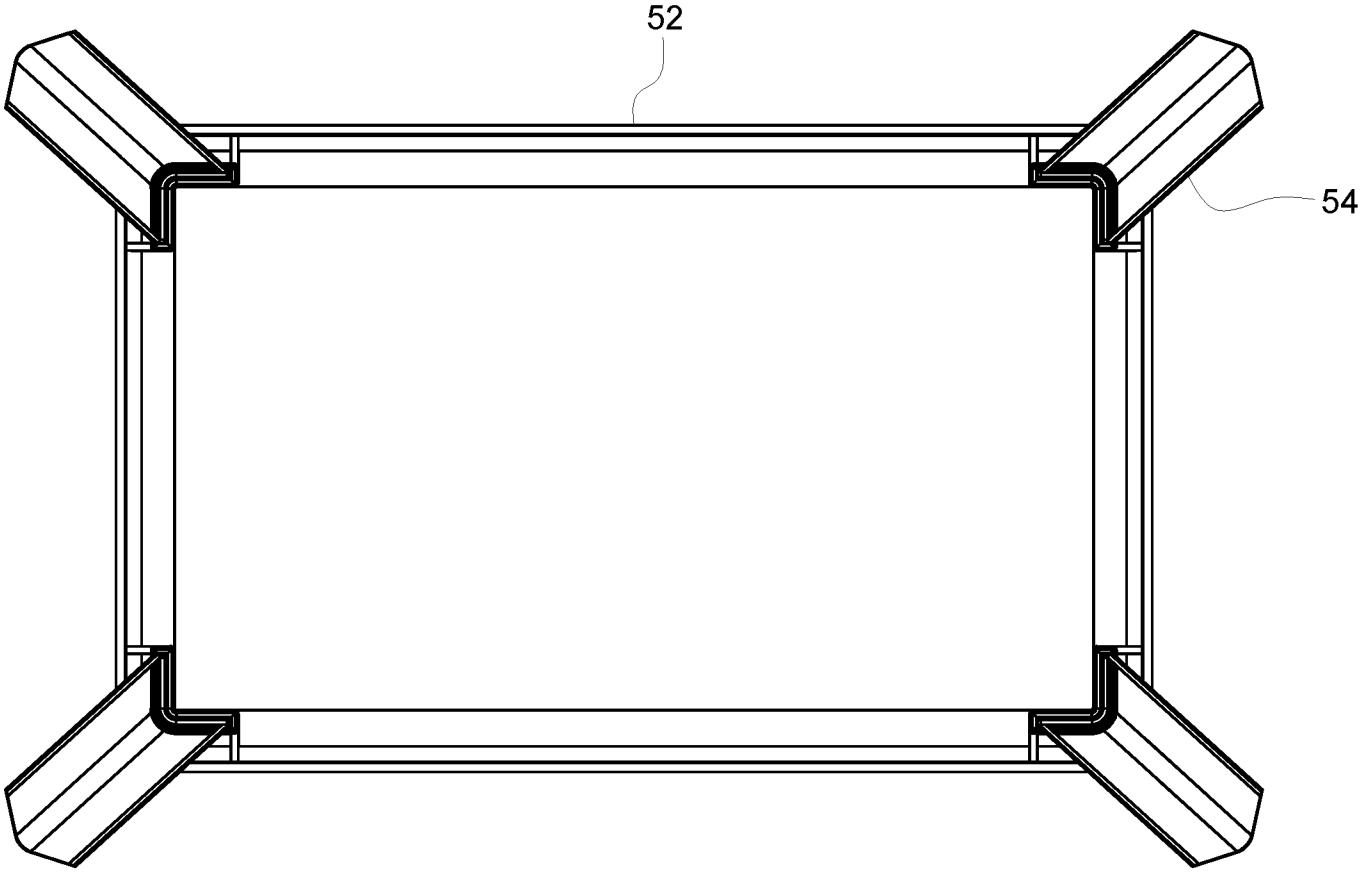
FIG. 7 is a bottom view of the bag frame of FIG. 5.
Figure 8:
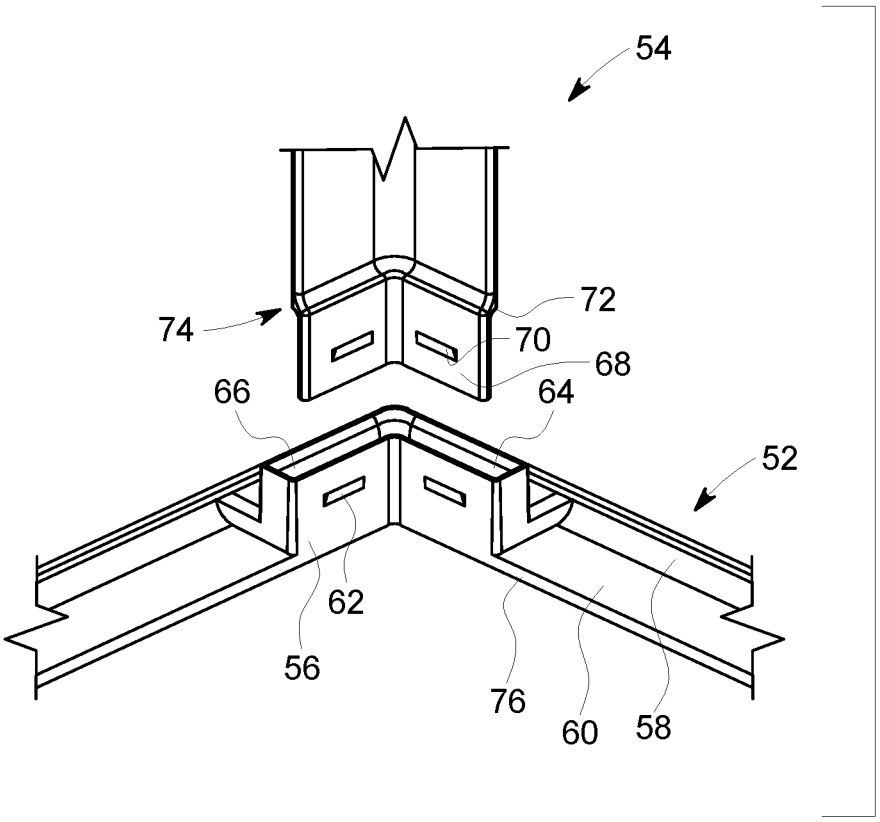
FIG. 8 is an exploded, detailed perspective view of a corner of the bag frame of FIG. 5.
Figure 9:
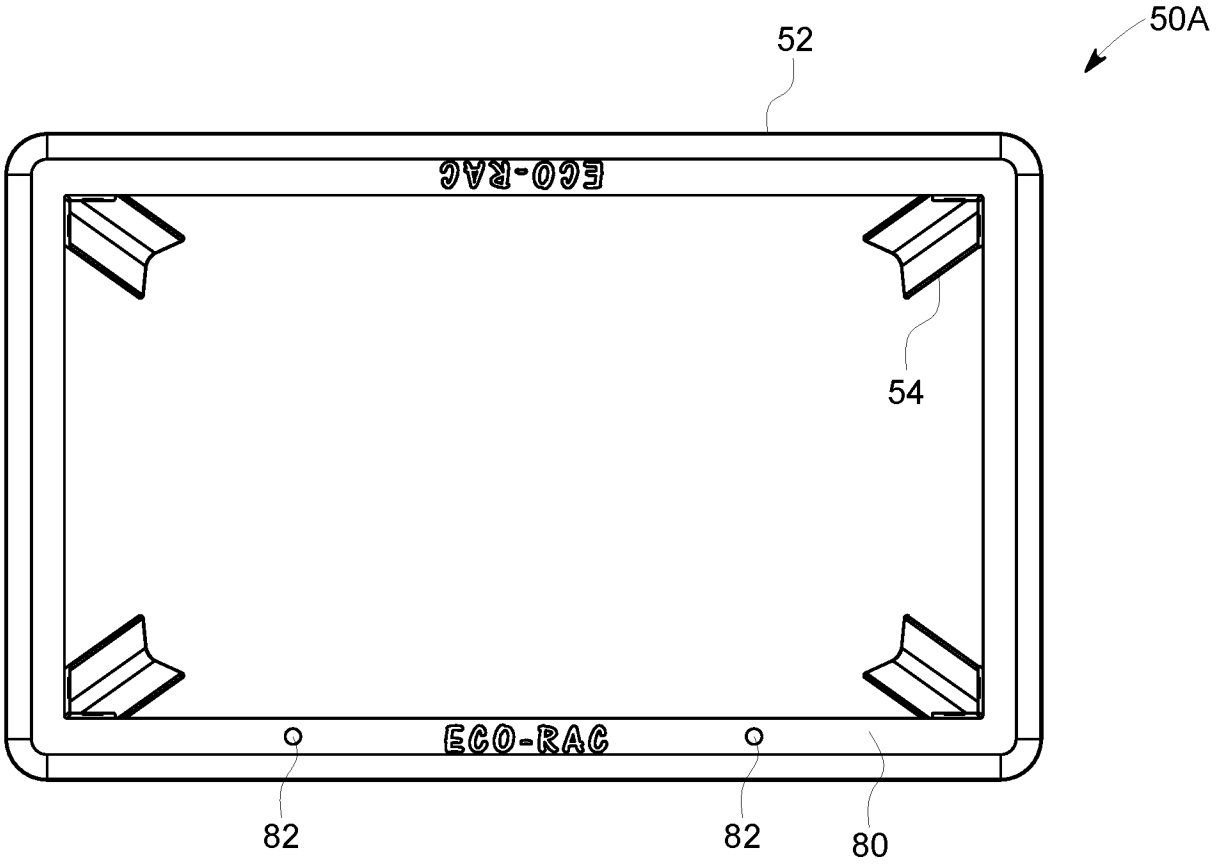
FIG. 9 is a top view of a bag frame having attachment members formed through a top portion thereof for attachment of removable decorative attachments according to an exemplary embodiment of the present invention.
Figure 10:
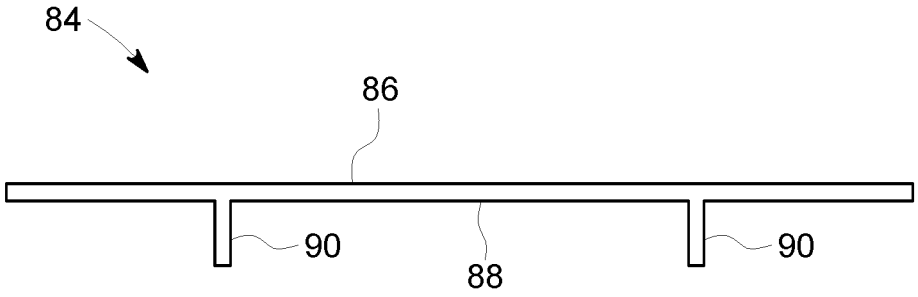
FIG. 10 is a side view of a decorative attachment member placeable into the attachment members of FIG. 9.
Figure 11:
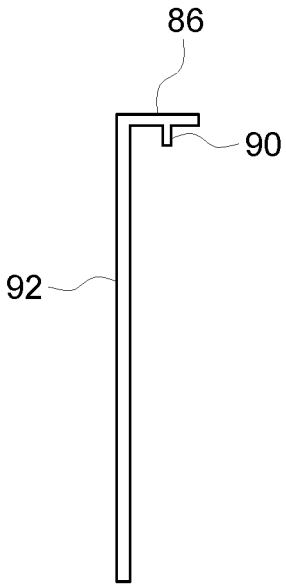
FIG. 11 is a side view of a decorative attachment member placeable into the attachment members of FIG. 9.

The bag frame 20 is shown exploded in FIGS. 4A-4F, and FIG. 4F, in particular, illustrates an exemplary quick-connect structure between the upper rim 24 and the top ends of the legs 26. In particular, the underside of the upper rim 24 can include four right-angled brackets 40 disposed at each of its four corners and extending downwardly therefrom, spaced inward from the outer vertical wall 36 but not so far as the inner edge of the opening 34. Each of the right-angled legs 36 can be configured to extend upward to the outside of one of the brackets 40 and snap into place. FIG. 3E illustrates a relatively short flange 42 positioned just outside of each bracket 40 and extending downward from the underside of the upper rim 24. The top end of each leg 26 may fit within a small right-angle slot defined between the bracket 40 and the flange 42 as shown. Two small teeth or tabs 44 on inside walls of each leg 26 may snap into similarly-sized receptacles 46 in both walls of the right-angled brackets 40. Although the legs 26 are firmly held together with the upper rim 24, they can be disconnected using a minimum amount of force. Of course, other connectors, such as those described below, are contemplated within the scope of the present invention, provided that such connections permit the legs to be removably attached to the top. In some embodiments, the legs may be permanently affixed to the top or may be molded integrally with the top.

Referring now to FIGS. 5 through 8, a bag frame 50 can include an upper member 52 with legs 54 extending therefrom. The upper member 52 may be formed as geometric or non-geometric shape, such as a rectangle, with an opening formed therethrough, as shown in the Figures. Typically, as shown, four legs 54 extend from each of four corners of the rectangular-shaped upper member 52. Of course, other shapes for the upper member 52 are contemplated within the scope of the present invention. For example, a triangular or rectangular upper member may be supported by three legs.

The upper member 52 may include leg attachment sections 56 for removably attaching each of the legs 54. The leg attachment sections 56 can protrude away from a plane defined by the upper member 52 and may be formed integrally therewith. The leg attachment sections 56 can include a slot 64 for insertion of the legs 54 therein. The leg attachment sections 56 can further include a protruding portion 66 that protrudes into and narrows the slot 64. The leg attachment sections 56 may be flush with an interior periphery 76 of the opening in the upper member 52. Typically, the slots 64 of the leg attachment section 56 is shaped in an L-shape at each corner of the upper member 52.

In some embodiments, the legs 54 can be formed with a jog 74 therein, where a lip 72 formed by the jog 74 may rest against the protruding portion 66 when an end portion 68 of the leg 54 is inserted and engaged with the leg attachment section 56. In some embodiments, the legs 54 may include one or more tabs 72, such as two tabs 70, which may engage with openings 62 of the leg attachment sections 56. The tabs 70 may fit into the openings 62 to prevent inadvertent disengagement of the legs 54 from the leg attachment sections 56. The tabs 70 may be designed to permit removal of the legs 54 from the slots 64 without the use of tools but may further prevent inadvertent disengagement of the legs 54 during normal use, such as when changing the bags used with the frame.

In some embodiments, the upper member 52 can include an outer periphery side 58 (or simply side 58) that extends away from the plane defined by the upper member 52 in generally the same direction as the leg attachment sections 56. When the bag frame 50 is engaged with a bag, the upper surface of the opening of the bag may rest against the bottom side 60 of the upper member 52, between the side 58 of the top member and the leg attachment sections 56. Typically, the upper member 52 is shaped to match the size and shape of the bag.

Referring to FIGS. 9 through 12, the bag frame 50A can be printed with various colors, decorations, logos, or the like. In some embodiments, one or more attachment members 82 may be formed in the upper member 52. The attachment members 82 may be holes formed through the upper member 52. Of course, other types of attachment members may be contemplated within the scope of the present invention, including hook and loop fastener, adhesive, snaps, or the like. The attachment members 82 may receive a decorative element 84 therein. The decorative element 84 may include mating attachment members 90, extending from a bottom side 88 thereof, to mate with the attachment members 82 of the upper member 52, thereby mating the decorative element 84 to the bag frame. An upper surface 86 of the decorative element 84 may be decorated with logos, colors, sport team designators, or the like. In some embodiments, a three dimensional shape may extend away from the upper surface 86, such as a fictional character, a sporting element, or the like.

Figure 12:
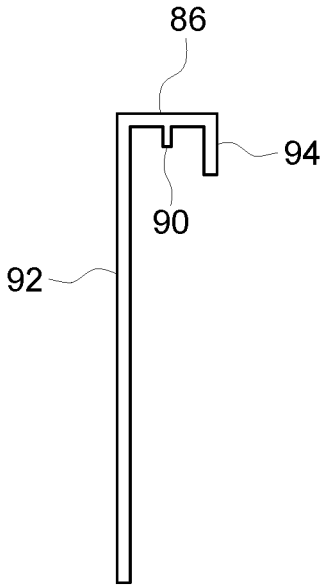
FIG. 12 is a side view of a decorative attachment member placeable into the attachment members of FIG. 9.

In some embodiment, as shown in FIG. 12, the decorative element may include a front face 92 that extends downward from the upper member 52 of the bag frame, thus covering some or all of one or more sides of the paper bag. Similar to the upper surface 86, the front face 92 of the decorative element may include any design, logo, surface impressions, or the like, as desired by the user. As shown in FIG. 12, the decorative element may include a rear face 94 that extends downward inside the interior opening of the upper member 52. In this manner, the decorative element may completely hide any exposed portions of the upper member 52, forming a design that may be interchanged by the user.

In some embodiments, the attachment members 82 may be used to attach other items, such as a basketball hoop, for example, where the hoop may be positioned above and over the opening of the upper member 52. In some embodiments, this added structure, such as a basketball hoop, may be formed integrally with the upper member 52. Other elements, such as backboards, displays, or the like, may be attached to or formed integrally with the bag frame.

Figure 13:
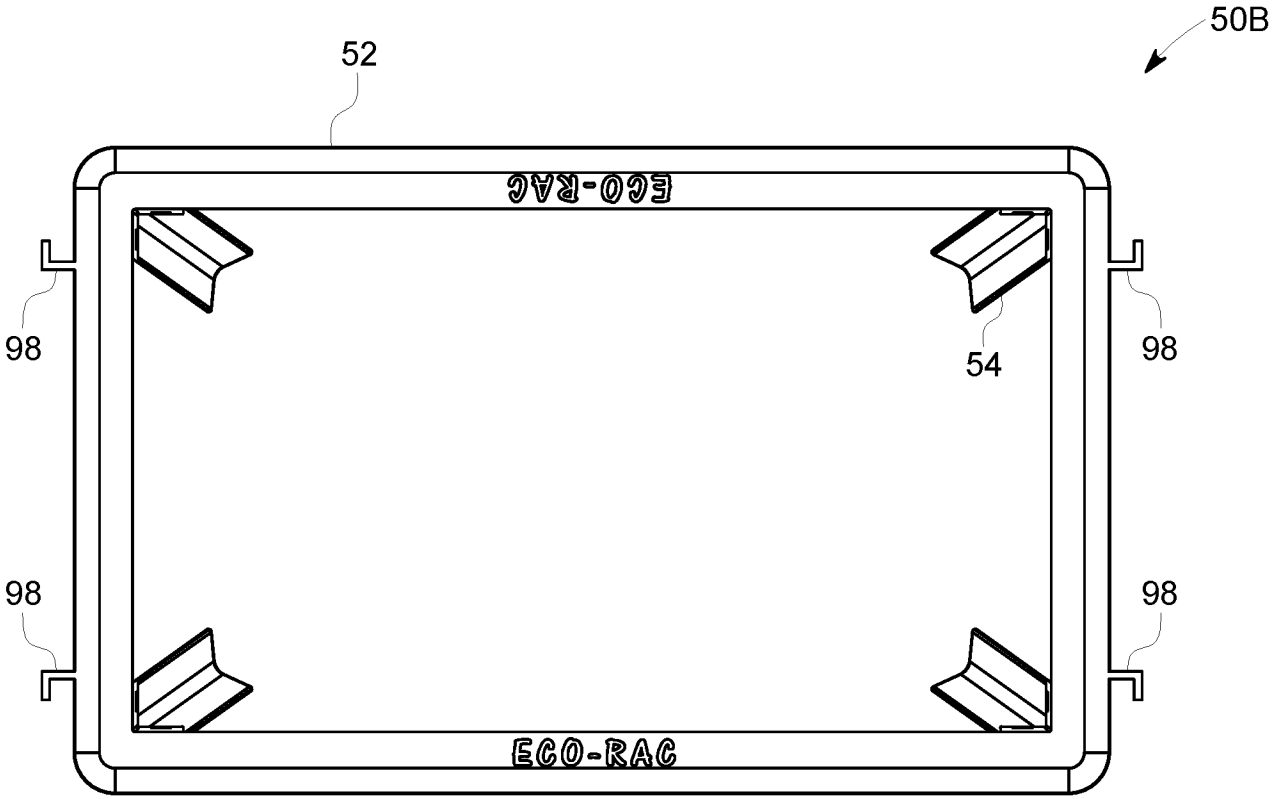
FIG. 13 is a top view of a bag frame having attachment member extending from an outer periphery thereof, according to an exemplary embodiment of the present invention.

As shown in FIG. 13, in some embodiments, protrusions 98 may extend outward from sides of the upper member 52. In some embodiments, the protrusions 98 may be L-shaped, where a plastic bag handle may be threaded along the protrusions 98 when the legs 54 are inserted into the plastic bag, thus preventing the collapse of the plastic bag used with the bag frame 50B.

The exemplary bag frame is intended to insert inside a standard paper grocery sack/bag in order to create a sturdy waste or other receptacle. This device not only extends the life of a usually discarded grocery bag, it can be used in many ways for recycling as well as numerous marketing, advertising and brand placement opportunities.

The bag frame insert is a simple design with no moving parts. The frame is desirably formed with hard plastic and resembles a small bedside table with four legs and no actual top. Its dimensions may be of a standard paper grocery bag where the top frame can create a sturdy rim with four legs which are designed to fit snug within the interior corners of the bags exact width and height.

This device is an ideal waste can for bathrooms, kitchen & bedrooms for the use of paper products such as Kleenex, tampons, used razors, shampoo bottles, wrappers, recyclables and other light waste. To use with wet items, simply attach a plastic insert to optional integrated tabs in some models which are conveniently designed to accommodate your standard plastic grocery sack. The plastic bags could be used with or without the paper bag exterior.

This design allows not only for a green opportunity in that it creates an extended life of an ordinarily discarded paper bag, the receptacles may also themselves be used to separate different recyclable materials, designated by color (Blue, green & red) for separating paper, glass & cans. The recycle logo could also be used.

The frame or rim section creates all types of opportunities for advertising and design options for commercial use. This area can be used to market a logo or design for a store or business from which it was purchased or advertising a company name where the bag frame has been given as a promotion by large companies as a gift. Example: Vons, Ralphs, Marborg, BFI or even Facebook or Google.

The bag frame can be personalized and sold as a design item with unique colors, shapes, personalized with names or expressing fashion trends & designs for children's bedrooms, baths or areas where it's visible. The frame may become a customized in gift stores with gems, trinkets or even bedazzled. Children's hobby kits or sets with glue-on accessories or jewels may be sold to personalize the frame. A stainless-steel version could be an option for the high-end client, and sold in Skymall, gadget stores or shopping outlets.

With the frame 20, 50 disclosed herein, one will never have to buy trash bags again as long as grocery stores are bagging groceries. They say they are phasing out the free bags, however the mass consumer will never conform to bringing their own bags.

The frame also appeals to the stores, as this concept obviously creates added exposure to the advertising on the bags. The product might actually inspire establishments using paper bags to step up their designs and appeal of their bags in order to attract shoppers with their prettier more attractive bags as they will be getting more exposure since they are being used as waste receptacles around people's homes. (Decorative bag incentive).

The bag frame could have a tremendous effect on the recycle industry as it may very well help eliminate the plastic bag all together. The bag frame should inspire people to choose paper over plastic which will help eliminate the trash in our oceans and streams which is killing birds and fish, not to mention the reduction of waste in our landfills and that big plastic island floating in the middle of the ocean. Ideally paper is biodegradable within days, is recyclable, it can be grown and it's a better alternative to plastic as it eliminates the additional expense of trash can liners in this difficult economy.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Claim elements and steps herein may have been numbered and/or lettered solely as an aid in readability and understanding. Any such numbering and lettering in itself is not intended to and should not be taken to indicate the ordering of elements and/or steps in the claims.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different ones of the disclosed elements.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what incorporates the essential idea of the invention.

What is claimed is:

1. A frame for supporting a bag, comprising:

a one-piece upper member circumscribing an opening formed there through;

a top portion of the upper member having a width defining a top surface and a bottom surface;

a side wall of the upper member extending downward;

a plurality of leg attachment sections extending from the upper member;

a plurality of legs extending from the leg attachment sections for inserting in the bag, wherein a plane defined by an outer surface of each of the plurality of legs intersects the bottom surface of the top portion of the upper member; and, the side member extends downward from the upper member about an outer periphery thereof and the plurality of leg attachment sections extending from an inner periphery of the upper member, where the plurality of leg attachment sections is spaced apart from the side member.

2. The frame of claim 1, wherein the plurality of legs are removably attached to the plurality of leg attachment sections.

3. The frame of claim 1, wherein the plurality of leg attachment members each include a slot for receiving an end portion of each of the plurality of legs.

4. The frame of claim 3, further comprising a protrusion extending into the slot from one side thereof, wherein a portion of the plurality of legs rest against the protrusion.

5. The frame of claim 4, wherein each of the plurality of legs have a jog formed in a longitudinal direction thereof from a first side of each of the plurality of legs to an opposite side thereof, wherein a lip formed by the jog rests against the protrusion when the end portion of each of the plurality of legs is inserted into the slot.

6. The frame of claim 5, wherein the leg attachment portion includes an opening for receiving a tab formed on the leg when the leg is fully inserted into the slot.

7. The frame of claim 1, further comprising at least one attachment member formed in the upper member.

8. The frame of claim 7, further comprising at least one decorative element removably attached to the at least one attachment member.

9. The frame of claim 8, wherein the at least one decorative element includes a front face extending from a top portion of the decorative element, the front face covering at least a portion of one or more sides of a bag fitted about the legs with an open end of the bag disposed against a bottom side of the upper member.

10. The frame of claim 8, wherein the at least one decorative element includes an inner downward protruding face extending downward into a bag fitted about the legs with an open end of the bag disposed against a bottom side of the upper member.

11. The frame of claim 1, further comprising at least one protruding member extending outward from the upper member.

12. The frame of claim 11, wherein the at least one protruding member includes two sets of two protruding members disposed on opposite sides of the upper member.

13. A frame for the supporting a bag, comprising:

a one-piece upper member circumscribing an opening formed there through;

a top portion of the upper member having a width defining a top surface and a bottom surface;

a side wall of the upper member extending downward;

a plurality of leg attachment sections extending from the upper member;

a plurality of legs extending from the leg attachment sections for inserting in a bag; and the bag fitting about the legs with an open end of the hag disposed against a bottom side of the upper member, wherein a plane defined by an outer surface of each of the plurality of legs intersects the bottom surface of the top portion of the upper member.

14. A method of repurposing a paper bag, comprising:

opening the paper bag;

inserting a plurality of legs of a frame into the opened paper bag, the frame including a one-piece upper member circumscribing an opening formed there through, a top portion of the upper member having a width defining a top surface and a bottom surface, a side wall of the upper member extending downward, a plurality of leg attachment sections extending from the upper member, wherein a plurality extend from the leg attachment sections, and wherein a plane defined by an outer surface of each of the plurality of legs intersects the bottom surface of the top portion of the upper member; and disposing an entirety of an open end of the bag against the width of the bottom surface of the upper member.

15. The method of claim 14, wherein the upper member includes a side member extending downward from the upper surface of the upper member about an outer periphery thereof.

16. The method of claim 14, further comprising inserting an end portion of each of the plurality of legs into slots formed in each of the plurality of leg attachment members.

17. The method of claim 16, further comprising forming a protrusion that extends into the slot from one side thereof, wherein a portion of the plurality of legs rest against the protrusion.

18. The method of claim 14, further comprising engaging a tab formed in each of the plurality of legs with an opening formed in the leg attachment portion.

19. The method of claim 14, further comprising removably adding a decorative element to the frame by inserting at least one mating attachment member of the decorative element into at least one attachment member formed in the upper member.

* * * * *